US005826145A

United States Patent [19]

Fukae

[11] Patent Number: 5,826,145

[45] Date of Patent: Oct. 20, 1998

[54] ELECTROGRAPHIC PRINTING APPARATUS WITH A LIQUID DEVELOPEMENT SYSTEM

[75] Inventor: Kensuke Fukae, Boulder, Colo.

[73] Assignee: Advanced Color Technology, Inc., Boulder, Colo.

[21] Appl. No.: 856,635

[22] Filed: May 14, 1997

[51] Int. Cl.[6] ..... G03G 15/10

[52] U.S. Cl. ..... 399/233; 399/237

[58] Field of Search ..... 399/127, 233, 399/237–239, 251

[56] References Cited

U.S. PATENT DOCUMENTS

| | | | |
|---|---|---|---|
| 3,806,354 | 4/1974 | Amidon et al. . | |
| 3,901,700 | 8/1975 | Yoerger et al. | 430/49 |
| 3,954,640 | 5/1976 | Lu et al. | 430/114 |
| 5,530,532 | 6/1996 | Iino et al. | 399/237 |
| 5,561,507 | 10/1996 | Shelffo et al. | 399/237 |
| 5,592,269 | 1/1997 | Younes et al. | 399/237 |
| 5,596,396 | 1/1997 | Landa et al. | 399/237 |

OTHER PUBLICATIONS

The E–print 1000, Digital Offset Color Brochure from Indigo.

Xeikon DCP–1, Brochure of AM Mutligraphics.

IBM 3170 Full Color Digital Printer, Brochure of IBM, Oct. 1995.

*Primary Examiner*—William J. Royer

*Attorney, Agent, or Firm*—Meltzer, Lippe, Goldstein, et al.

[57] ABSTRACT

An electrographic printing apparatus comprises a rotatable charge bearing member, a rotatable roller assembly which applies a chargeable pre-wetting oil to the surface of the charge bearing member, a charger assembly which applies uniform charge to the surface of the charge bearing member and/or the pre-wetting oil coating, and a light source which discharges selected areas on the charge bearing member and/or the pre-wetting oil to produce a latent electrostatic image thereon. The electrographic printing apparatus further comprises a liquid development system comprising an ink head assembly which applies liquid toner to the charge bearing member thereby developing the latent electrostatic image, and a rotatable transfer member which receives the developed image from the charge bearing member and then transfers it to a substrate such as paper. The electrographic printing apparatus may also be adapted to produce color images on the substrate.

42 Claims, 5 Drawing Sheets

ELECTROGRAPHIC PRINTING APPARATUS WITH A LIQUID DEVELOPEMENT SYSTEM

FIELD OF THE INVENTION

The present invention relates to an electrographic printing apparatus with a liquid development system. More specifically, the present invention relates to a liquid development system which includes a transfer member for transferring a developed image from a charge bearing member to a substrate. One advantage of the inventive liquid development system is that it uses a straight paper path when transferring and fixing a latent image onto the substrate.

BACKGROUND OF THE INVENTION

So There are basically two known methods of developing electrostatic latent images. These methods include a liquid developing system and a dry developing system. The liquid developing system uses a toner which is suspended in an insulating liquid. This liquid is normally a volatile organic compound which wets the surface of a charge bearing member, thereby producing a film of the organic compound. A portion of the film is transferred together with the developed image to the paper or substrate, and the volatile organic liquid then normally evaporates into the atmosphere.

The dry developing system uses a toner which is applied in a powdered form. The toner is normally fixed to a paper or substrate by fusing the toner into the paper or substrate.

The present invention relates to a liquid toner developing system for an electrographic printing apparatus.

Several patents that describe liquid development systems and components thereof are discussed below.

U.S. Pat. No. 3,806,354, to Amidon et al., discloses an electrographic imaging system wherein an electrostatic latent image is developed on a reusable electrographic imaging surface. This imaging system transfers the developed image directly from the reusable electrographic imaging surface to a substrate.

U.S. Pat. No. 3,954,640, to Lu et al., discloses several liquid developer compositions which are used in the development of latent electrostatic images.

U.S. Pat. No. 3,901,700, to Yoerger et al., discloses an electrographic element having a conductive support bearing a specific repellant composition. The repellant composition is used to prepare an ink repellant surface for a "waterless" lithoplate or as a coating on the surface of a electrographic element from which a developed image is transferred.

The printing systems described above which employ liquid development systems, as well as other printing systems which are currently available, are typically slow (i.e., print at a rate of about 80 pages per minute) and are in constant need of repair due to problems caused by the jamming of paper in the paper pathway. In addition, the printing systems currently available use a low viscosity liquid toner that contains a flammable petro-chemical derivative solvent which, because of its flammable nature, cannot be used in an office environment. Moreover, the petro-chemical based low viscosity liquid toner cannot be used with an electrographic printing system because it may cause damage to the components of the electrographic printing system.

None of the prior art systems disclose a liquid development system for an electrographic printing apparatus that uses a cascading roller apparatus or utilize the surface tension of an oil based liquid toner to apply the liquid toner to a surface in a manner similar to the mechanism used in an offset printing apparatus. In addition, none of the liquid development systems for an electrographic printing apparatus include a charged brush which applies liquid toner to a surface of a charge bearing member so as to develop an image thereon and a transfer member for transferring the developed image from the charge bearing member to a substrate. The transfer of the developed image to the transfer member and then to the substrate in accordance with the present invention produces a sharper image at a printing speed of about 120 pages per minute. In addition, the use of a straight paper path when transferring and fixing the image onto a substrate reduces the amount of repairs caused by paper jams.

SUMMARY OF THE INVENTION

In accordance with the present invention, an electrographic printing apparatus with a liquid development system comprises a rotatable charge bearing member, a rotatable roller assembly which applies a chargeable pre-wetting oil to the surface of the charge bearing member, a charger assembly which applies a uniform charge to the surface of the charge bearing member and/or the pre-wetting oil coating, and a light source which discharges selected areas on the charge bearing member and/or the pre-wetting oil to produce a latent electrostatic image thereon. The electrographic printing apparatus further comprises a liquid development system comprising an ink head assembly which applies liquid toner to the charge bearing member thereby developing the latent electrostatic image, and a rotatable transfer member which receives the developed image from the charge bearing member and then transfers it to a substrate such as paper. The printing apparatus may also include a cleaning unit to prepare the charge bearing member for the next sequence of printing.

In a preferred embodiment the printing apparatus described above includes a substantially straight paper path along which the substrate travels past the transfer member. The straight paper path reduces the amount of repairs normally associated with a curved paper path.

The inventive electrographic printing apparatus can be adapted for color printing by including separate subunits for developing the electrostatic latent images in different colors, each of the subunits comprising a charge bearing member, a roller assembly, a charger assembly, a light source, an ink head assembly, and a transfer member as described above.

The electrographic printing apparatus described above is used to develop electrostatic latent images. A process for developing an electrostatic latent image in an electrographic printing apparatus comprises wetting the surface of a photoconductive member with a pre-wetting oil and then charging the pre-wetting oil on the surface of the photoconductive member to a substantially uniform potential in order to sensitize the surface thereof. In the alternative the photoconductive member itself can be charged without the application of pre-wetting oil. Selected portions of the charged photoconductive member are then exposed by a light source to produce an electrostatic latent image thereon.

The inventive electrographic printing apparatus may be a printer, in which case the intensity and direction of the light source is controlled by an external source, such as a computer. Alternatively, the inventive electrographic printing apparatus may be a copier, in which case the light source is the reflected image of a document. The light source discharges areas of the photoconductive member to produce an electrostatic latent image which corresponds to the informational areas to be printed.

Once the electrostatic latent image is produced on the photoconductive member, the latent image is developed by bringing a liquid developer into contact therewith. The liquid developer material comprises a liquid carrier having liquid development particles, such as toner particles suspended therein. The toner particles of the liquid developer material are deposited in an image configuration that corresponds to the informational areas contained within the electrostatic latent image on the photoconductive member. After the liquid developer particles are deposited on the latent image, the latent image becomes a developed (i.e., visible) image.

The developed image is then transferred to a transfer drum which transfers the image to a substrate, such as paper. Because of the use of the transfer drum, the paper path can be configured so that the substrate travels in a straight path thereby reducing the frequency of paper jams that often occur with curved paper paths. Once the developed image is transferred to the substrate from the transfer drum, the developer particles are permanently fused to the paper by dryers, or the substrate is allowed to air dry.

DETAILED DESCRIPTION OF THE PREFERRED EMBODIMENTS

Figure 1:
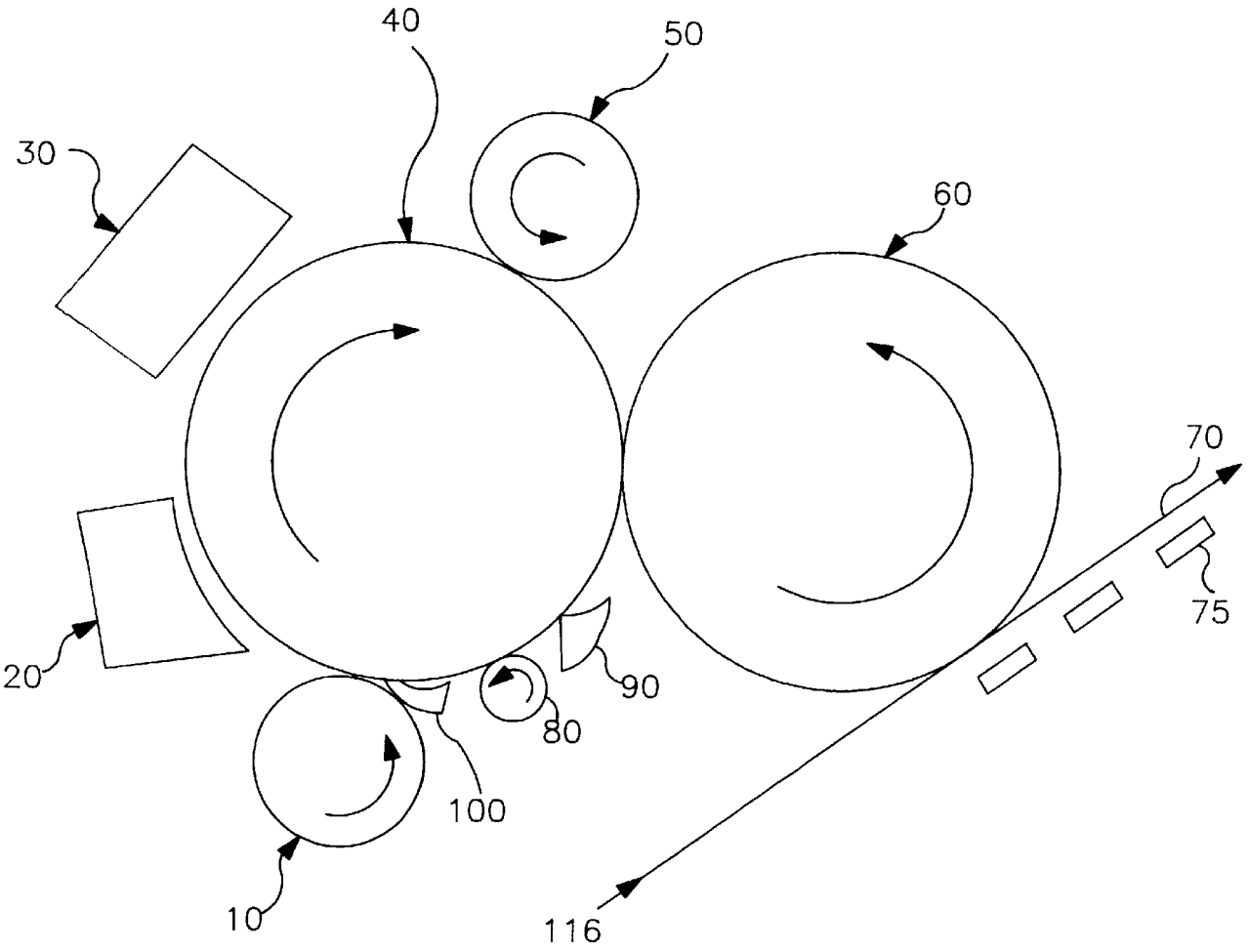
FIG. 1 illustrates an embodiment of the inventive electrographic printing apparatus with a liquid ink development system.

FIG. 1 illustrates an electrographic printing apparatus of the present invention which is based on the principles of "offset printing" and uses an electrophotographic process. Offset printing involves the transfer of an inked image from a printing plate to a substrate that is receptive to the ink. Offset printing is used, for example, to print newsprint.

The electrographic printing apparatus of FIG. 1 comprises a photoconductor 40 that has a surface that is capable of bearing a charge. For example, the surface of the photoconductor 40 may be made from an organic material capable of bearing and retaining a charge. Such organic materials are well known to those skilled in the art.

The photoconductor 40 is rotatable and is in direct contact with a pre-wetting roller assembly 10. The pre-wetting roller assembly 10 has a reservoir 100 connected to it that stores excess pre-wetting oil. The pre-wetting roller assembly 10 coats the photoconductor 40 with a thin layer of pre-wetting oil. The pre-wetting oil is a chargeable silicone oil that has a high volume resistivity, such as a dimethyl polysiloxane fluid (D.C.200) available from Dow Corning. Preferably, the oil viscosity is between 0.5 mPs and 5 mPs. The high volume resistivity of the silicone based pre-wetting oil preserves the latent image on the photoconductor 40 once it is formed. A layer 5 to 10 microns thick of the pre-wetting oil is applied to the photoconductor 40 by the pre-wetting roller assembly 10.

The 5 to 10 micron thickness of pre-wetting oil is achieved by transferring the pre-wetting oil from the reservoir 100 to a plurality of rollers 101, 102, 103 (see FIG. 4) and finally to photoconductor 40. Transferring the pre-wetting oil from one roller to the next methodically reduces the thickness of the pre-wetting oil so that a 5 to 10 microns thickness is eventually applied to the photoconductor 40.

Once the photoconductor 40 is coated with the pre-wetting oil, the thin layer of pre-wetting oil on the photoconductor 40 is uniformly charged to a relatively high, substantially uniform, potential by a corona 20. The corona 20 charges the coated photoconductor 40 as it rotates past the corona 20. Once charged, the coated photoconductor 40 continues to rotate so that its surface is positioned in the path of a light source 30 such as, e.g., an array of light emitting diodes (LED's) or a laser light source. The light source 30 emits high intensity light onto the coated photoconductor 40 to produce a latent image. The light source 30 is connected to an external control device, such as a computer, which controls the light emitted by the light source 30. An electrostatic latent image is produced on the coated photoconductor 40 by selectively exposing the coated photoconductor 40 in a manner that dissipates selected areas of charge from the uniformly charged pre-wetting oil. The electrostatic latent image that is produced on the photoconductor 40 corresponds to the informational areas of the document to be printed. Once the latent image is produced on the photoconductor 40, the photoconductor 40, now bearing an electrostatic latent image, continues to rotate so that it comes into contact with an ink head assembly 50.

When the ink head assembly 50 comes into contact with the latent image on the photoconductor 40, it advances a developing solution consisting of toner particles suspended in an oil solution, onto the coated photoconductor 40. Preferably, the developing solution is 60% solid toner particles and 40% oil. The oil has a viscosity of about 1000–3000 mPs. A preferred thickness of the developing solution deposited on the coated photoconductor 40 is between 5–10 microns which is maintained by ink head assembly 50 in the same way as the pre-wetting oil thickness is maintained by roller assembly 10.

The toner particles in the oil solution pass by electrophoresis to the electrostatic latent image on the photoconductor 40. The toner particles have an opposite charge to the discharged areas of the electrostatic latent image on the photoconductor 40. This enables the toner particles to adhere to the latent image on the photoconductor 40. For example, assuming the discharged areas on the surface of the photoconductor 40 are negatively charged, then the toner particles used must be positively charged so that they are attracted to the discharged areas forming the electrostatic latent image on the photoconductor 40. The polarity of the discharged areas of the photoconductor 40 is a function of the composition of pre-wetting oil as well as the composition of the photoconductor 40. The toner particles that will be used depends on the polarity of the charged photoconductor 40.

The photoconductor 40 is in direct contact with a transfer drum 60. Once the electrostatic latent image on the photoconductor 40 is developed by the toner particles, the electrostatic latent image becomes a developed image. The photoconductor 40 is then rotated so that the developed image comes into contact with the surface of the transfer drum 60. The developed image is then transferred from the surface of the photoconductor 40 to the transfer drum 60 by direct contact. The transfer drum 60 rotates in a direction which is counter to the direction of rotation of the photoconductor 40.

After the developed image is transferred to the transfer drum 60, the residue of toner particles and pre-wetting oil that remains on the photoconductor 40 is cleaned from the surface of the photoconductor 40 by a cleaning roller 80. As the residue is cleaned from the surface of the photoconductor 40, it is deposited into a waste bin 90. After the surface of the photoconductor 40 is cleaned, it is now ready for the next latent image.

As the transfer drum 60 continues to rotate, the developed image comes into direct contact with a substrate 70 traveling along a paper path 116 in the printing apparatus. One example of a substrate 70 is bonded paper. The developed image on the transfer drum 60 is transferred to the substrate 70 by direct contact pressure. After the developed image has been transferred to the substrate 70, it can be dried by a dryer unit 75 that is positioned along the pathway of substrate 70. Alternatively, the substrate can be allowed to air dry.

One advantage that is realized when using the inventive liquid development system is the speed and sharpness with which sheets can be printed. The inventive electrographic printing apparatus is capable of printing about 120 pages per minute in simplex format with a clarity of 1200 dots per square inch (DPI). Another advantage of the printing apparatus is the decrease in the number of paper jams. Since the path that the substrate 70 travels along in the printer is substantially straight, substrate jams which are often associated with a curved pathway, are eliminated almost entirely.

Figure 2:
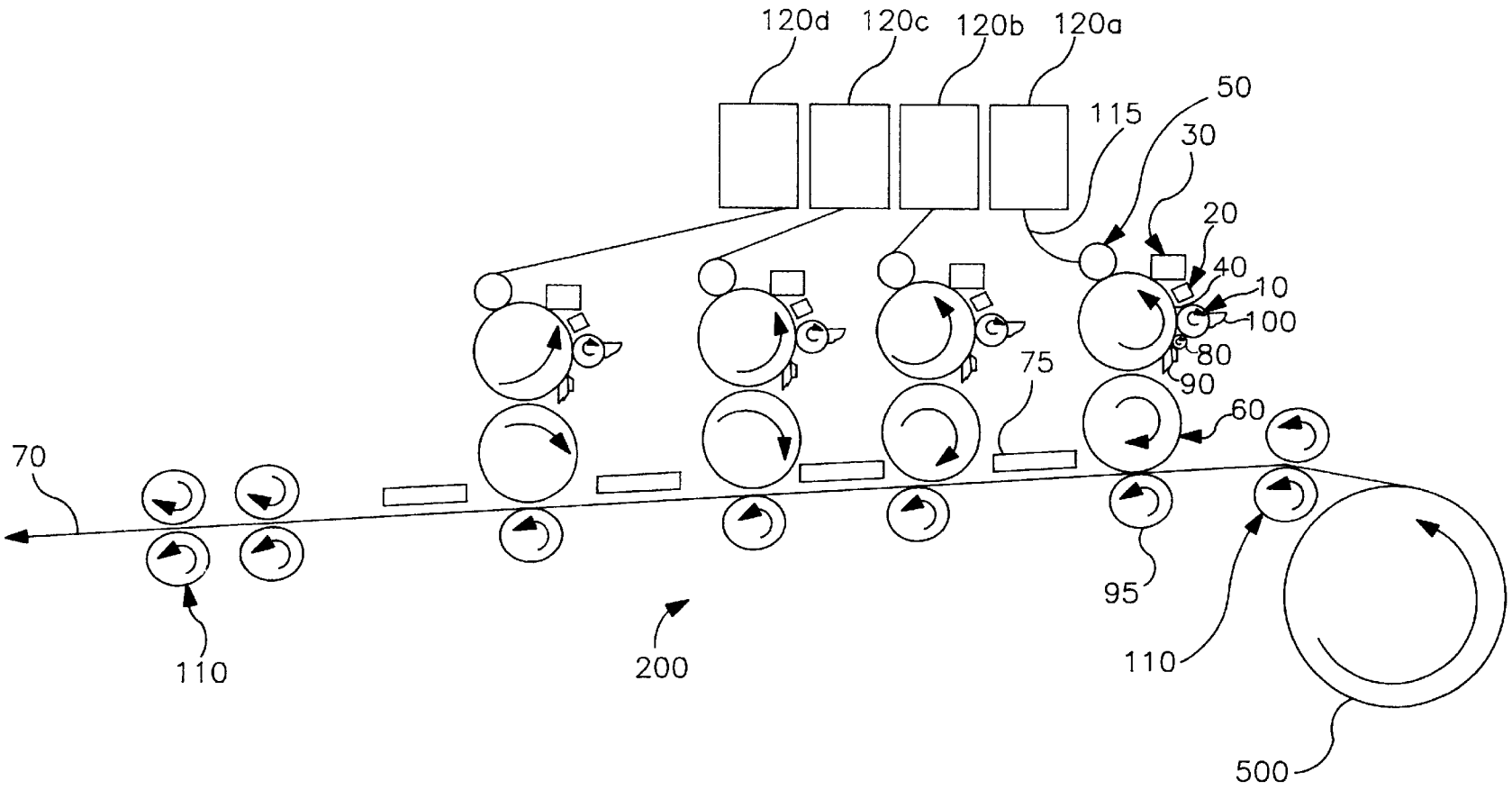
FIG. 2 shows an embodiment of the invention with a color development system.

The liquid development system described above can also be adapted for color printing. FIG. 2 illustrates a color printer that utilizes four different color toners to produce a colored document. The colors must include black ink and may include a suitable combination of blue, yellow, red, and green inks. The liquid color development system 200 comprises four toner feeder units 120*a*, 120*b* 120*c*, and 120*d*. Each of the toner units is connected to a liquid development system similar to that described above and shown in FIG. 1.

The first feeder unit 120*a* which may contain red toner is attached to the ink head assembly 50 of the first liquid development system by a transfer tube 115. The ink head assembly 50 advances red color toner suspended in oil to the electrostatic latent image on the photoconductor 40. The red color toner attaches to the discharged areas of the latent image by electrophoresis. The electrostatic latent image on the photoconductor 40 is produced in the same fashion as described above and shown in FIG. 1.

Once the electrostatic latent image on the photoconductor 40 is developed into a red image it is transferred to the transfer drum 60 by direct impression. The red developed image is then transferred from the transfer drum 60 to a paper 70 by direct contact impression. The paper 70 is advanced between the transfer drum 60 and an impression roller 95 in a straight path from a roll of paper 500 by advancing rollers 110.

Once the paper 70 is between the transfer drum 60 and the impression roller 95, the paper 70 is pressed firmly against the transfer drum 60 by the impression roller 95. This causes the red developed image on the transfer drum 60 to be transferred to the paper 70. Immediately after the red image is transferred to the paper 70, it is dried by dryer unit 75.

The paper 70 having the dried red developed image continues to advance in a straight path towards the second color liquid development system by advancing rollers 110. The second color liquid development system applies a second color on top of the red color image on the paper 70. This is achieved in the same fashion in which the first liquid color was applied to paper 70. Immediately after the second developed colored image is transferred to the paper 70, it is dried by dryer unit 75. The paper 70, having an image containing at least two colors, continues to advance in a straight paper path towards the third color liquid development system so that the third color can be applied. This process is repeated until all colors have been applied onto the paper 70. In the event that a single colored document is to be printed, e.g., only black is needed, three of the four color printing assemblies can be by-passed so that a single colored document is produced.

After the last color is applied and dried, a colored document is produced. Although a four color feeder unit is shown in FIG. 2, the color ink printer can be adapted to include more than four colors and red need not be the first color applied.

Figure 3:
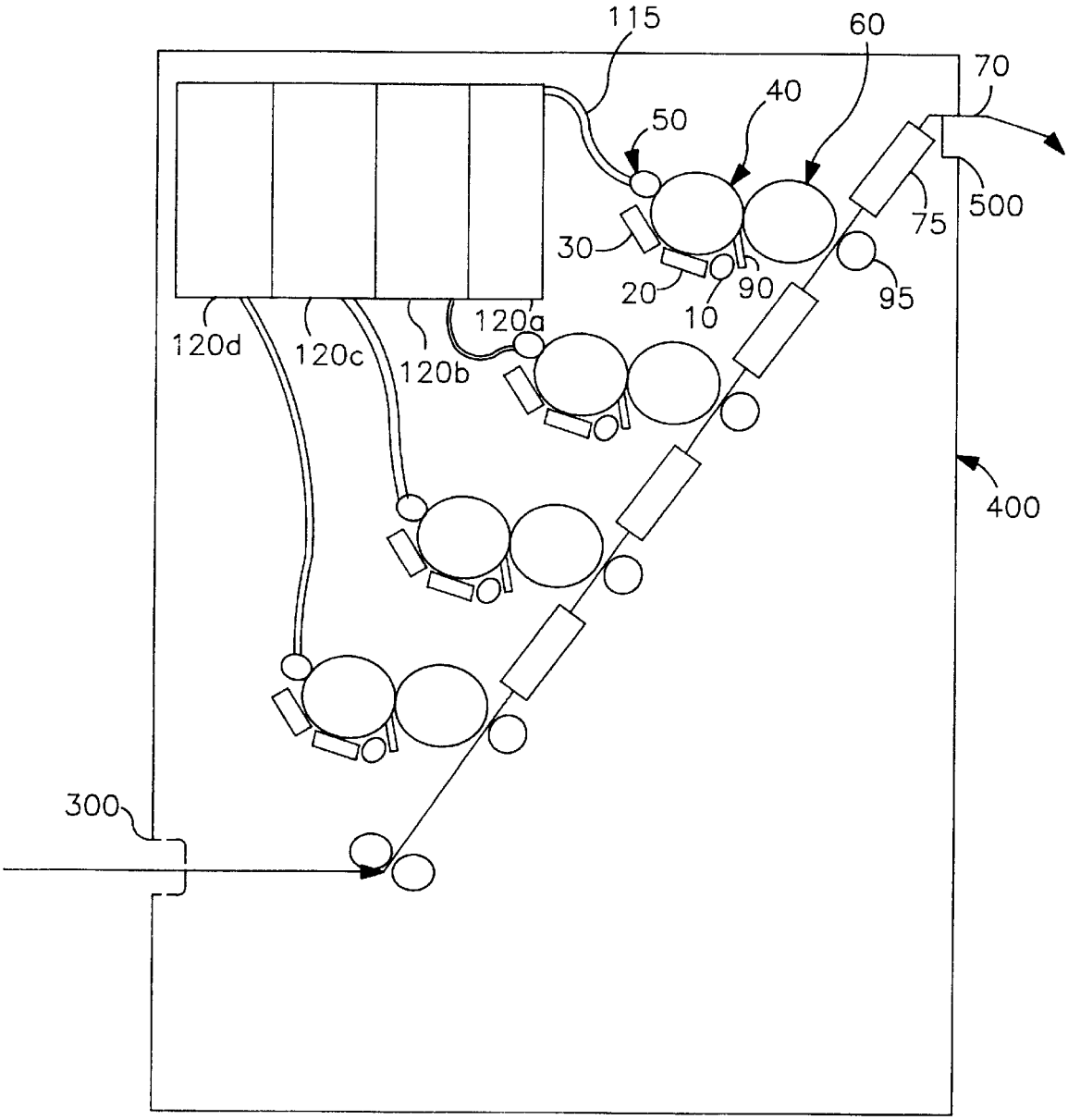
FIG. 3 shows another embodiment of a color printer using the color ink development system of FIG. 2.

FIG. 3 illustrates a cross-sectional view of a color printer utilizing the color liquid development system described above and having a substantially straight paper path. The straight path color printer has a paper input 300 at the lower end of the outer case 400 and a paper exit 500 at the upper end of the outer case 400. The paper travels in a straight path and therefore avoids most jams associated with a curved paper path. The color liquid development system is capable of printing about 120 pages per minute in simplex format.

Figure 4:
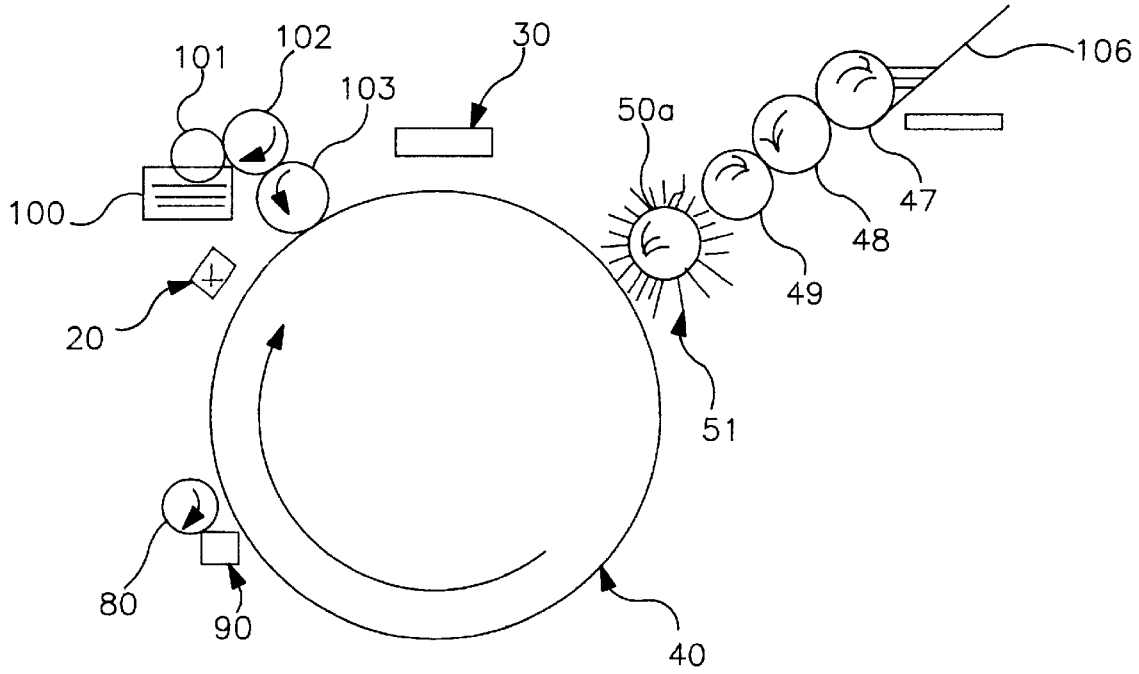
FIG. 4 shows in more detail a roller assembly for applying a pre-wetting oil to the photoconductor and an ink head assembly of electrographic printing apparatus.

FIG. 4 shows in more detail the pre-wetting roller assembly 10 which comprises a series of three rollers. The first roller 101 is at least partially submerged in reservoir 100 which holds excess pre-wetting oil. The second roller 102 is in contact with the first roller 101 at one point and the third roller 103 at another point. The third roller 103 is in contact with the photoconductor 40. As roller 101 rotates it becomes coated with pre-wetting oil which is transferred to roller 102. Roller 102 then transfers the pre-wetting oil to roller 103. Roller 103 then deposits the pre-wetting oil onto the photoconductor 40. This roller arrangement forms a 5 micron layer of pre-wetting oil on the photoconductor 40 as described above.

FIG. 4 also shows in detail the ink head assembly 50 in the form of a charged brush assembly for applying the liquid toner to the photoconductor 40. The assembly consists of a series of at least four rollers and a reservoir 106. The first roller 47 is in contact with the toner in reservoir 106. The second roller 48 is in contact with the first roller 47 and the third roller 49. The fourth roller 50*a* has extensions extending from its surface to form a brush 51. The extensions of the brush 51 are charged and are in contact with the photoconductor 40. The charged extensions of brush 51 are able to transfer the liquid toner from roller 49 to photoconductor 40 more efficiently. The oppositely charged brush 51 attracts most of the toner particles from roller 49 so that they can be deposited on photoconductor 40.

As roller 47 rotates, it draws toner from the reservoir 106 and places it onto roller 48. Roller 48 rotates in the opposite direction of roller 47 and deposits toner onto roller 49. Roller 49 in turn rotates and the extensions of the charged brush 51 on roller 50*a* attract the toner particles from roller 49 which are then deposited onto the latent image on the coated photoconductor 40. Although a four roller system is described, various combinations are also possible. The electrostatic latent image on the photoconductor 40 is then developed in the same fashion as described above.

Figure 5A:
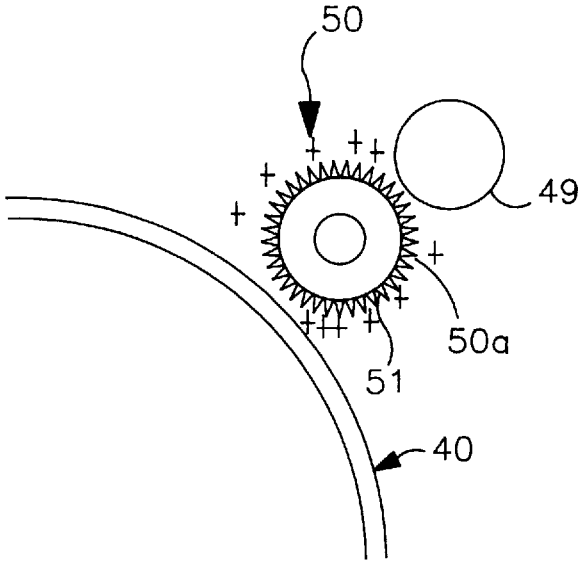
FIG. 5*a* shows the pre-wetting assembly in further detail.

FIG. 5*a* further illustrates the interaction between the ink head assembly 50 and the photoconductor 40. FIG. 5*a* shows a roller 50*a* having a plurality of bristles that collectively form a charged brush 51. The charged bristles of brush 51 are circumferentially arranged on the roller 50*a* and the charged brush 51 is in direct contact with roller 49 at one point and photoconductor 40 at another point. Positively charged toner particles are attracted to the brush 51 on roller 50*a* from roller 49 and then to photoconductor 40. The positively charged toner is attracted to the discharged area of the latent image on the photoconductor 40 which has a polarity opposite to the positively charged toner particles. The charged brush 51 aids in applying a 5–10 micron layer of the positively charged toner particles to the discharged areas on the photoconductor 40. The charge on brush 51 may be altered to accommodate differently charged toners.

Figure 5B:
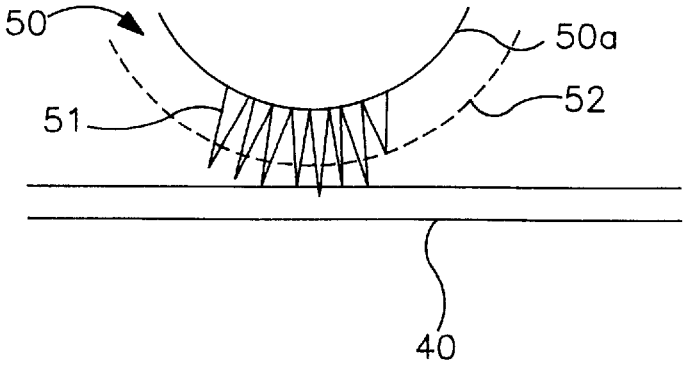
FIG. 5*b* shows the pre-wetting assembly of FIG. 5*a* in further greater detail.

FIG. 5*b* illustrates a layer of positively charged toner particles 52 which is suspended in the oppositely charged bristles of brush 51. A layer of positively charged toner particles 52 is formed in the bristles of brush 51 about halfway between the roller 50*a* and the surface of photoconductor 40. The layer of positively charged toner particles 52 aids in applying a 5–10 micron layer of the positively charged toner particles to the discharged area on photoconductor 40. The toner particles are transferred to the latent image on the photoconductor 40 to produce a developed image. Once the developed image is produced the process proceeds as described above.

While this invention has been described in conjunction with various embodiments, it is evident that many alternatives, modifications and variations will be apparent to those skilled in the art. Accordingly, it is intended to embrace all such alternatives, modifications and variations that fall within the spirit and broad scope of the appended claims.

I claim:

1. An electrographic printing apparatus with a liquid development system, comprising:

a) a rotatable charge bearing member having a chargeable surface;

b) a rotatable roller assembly configured to apply a chargeable pre-wetting oil to said chargeable surface;

c) a charger which charges said pre-wetting oil on said chargeable surface;

d) a discharging unit which discharges selected areas of said pre-wetting oil to produce an electrostatic latent image thereon;

e) an ink head assembly configured to apply liquid toner comprising solid toner particles and oil onto said electrostatic latent image to produce a developed image; and f) a transfer member having a surface configured to receive said developed image from said surface of said charge bearing member and then to transfer said developed image to a substrate.

2. The electrographic printing apparatus of claim 1 further comprising a substantially straight paper path along which said substrate travels past said transfer member.

3. The electrographic printing apparatus of claim 1 further comprising at least one dryer unit configured to dry said developed image on said substrate.

4. The electrographic printing apparatus of claim 1 wherein said charge bearing member is an organic photoconductor drum.

5. The electrographic printing apparatus of claim 1 wherein said charger is a corona.

6. The electrographic printing apparatus of claim 1 further comprising a cleaning roller configured to clean said chargeable surface;

a waste bin which stores residue cleaned from said chargeable surface by said cleaning roller; and a pre-wetting oil reservoir which supplies said rotatable roller assembly with said pre-wetting oil.

7. The electrographic printing apparatus of claim 1 wherein said rotatable roller assembly comprises at least first and second rollers in contact with one another so that said pre-wetting oil is transferred from said first roller to said second roller, and from said second roller to said charge bearing member.

8. The electrographic printing apparatus of claim 1 wherein said ink head assembly comprises at least first and second rollers in contact with one another so that said ink is transferred from said first roller to said second roller and from said second roller to said charge bearing member.

9. The electrographic printing apparatus of claim 1 comprising a plurality of ink head assemblies of different colors configured to apply liquid color toner of a particular color to said charge bearing member to produce a colored developed image.

10. The electrographic printing apparatus of claim 1 wherein said chargeable surface is in contact with said surface of said transfer member so that said developed image is transferred from said charge bearing surface to said surface of said transfer member by contact pressure.

11. The electrographic printing apparatus of claim 1 wherein said surface of said transfer member is in contact with said substrate so that said developed image is transferred from said surface of said transfer member to said substrate by contact pressure.

12. The electrographic printing apparatus of claim 1 further comprising, impression rollers positioned to press said substrate against said surface of said transfer member so that said developed image is transferred to said substrate by contact pressure.

13. A method for producing an image on a charge bearing member and transferring said image to a substrate comprising:

applying a pre-wetting oil to a charge bearing surface of said charge bearing member;

charging said coated charge bearing member surface;

discharging selected areas of said coated charge bearing surface to form an electrostatic latent image thereon;

applying a liquid toner comprising solid toner particles and oil to said coated charge bearing surface to produce a developed image;

transferring said developed image to a transfer drum; and transferring said developed image from said transfer drum to a substrate thereby producing a developed image on said substrate.

14. The method of claim 13 wherein said substrate travels past said transfer member in a substantially straight path.

15. The method of claim 13, wherein said pre-wetting oil is applied to said charge bearing surface to a thickness of about 5–10 microns.

16. The method of claim 13, wherein said liquid toner is applied to said charge bearing member to a thickness of about 5 to 30 microns.

17. The method of claim 13 further comprising drying said developed image on said substrate.

18. The method of claim 13 further comprising cleaning said charge bearing member after said developed image has been transferred to said substrate.

19. A color electrographic printing apparatus having at least first and second differently colored liquid development assemblies arranged in series, each of said liquid development assemblies comprising:

a) a rotatable charge bearing member having a chargeable surface;

b) a rotatable roller assembly configured to apply a chargeable pre-wetting oil to said chargeable surface;

c) a charger which charges said pre-wetting oil on said chargeable surface;

d) a discharging unit which discharges selected areas of said pre-wetting oil to produce an electrostatic latent image thereon;

e) an ink head assembly configured to apply liquid color toner comprising solid toner particles and oil of a particular color to said electrostatic latent image on said chargeable surface of said charge bearing member to produce a colored developed image;

f) a transfer member having a surface configured to receive said colored developed image from said charge bearing member; and g) a paper path along which a substrate travels past each said transfer member one after another, said substrate coming into contact with each said transfer member, so that said colored developed image on said surface of each said transfer member is transferred to said substrate in series.

20. The color electrographic printing apparatus of claim 19 wherein said paper path along which said substrate travels past each said transfer member is substantially straight.

21. The color electrographic printing apparatus of claim 19 wherein each of said liquid development assemblies further comprises a dryer unit configured to dry said colored developed image on said substrate.

22. The color electrographic printing apparatus of claim 19 wherein each of said liquid development assemblies further comprises impression rollers positioned to press said substrate against said surface of each said transfer member so that said colored developed image is transferred to said substrate.

23. The color electrographic printing apparatus of claim 19 further comprising advancing rollers configured to advance said substrate past said liquid development assemblies.

24. The color electrographic printing apparatus of claim 19 wherein each of said liquid development assemblies further comprises a cleaning roller configured to clean said chargeable surface of each said charge bearing member;

a waste bin which stores residue cleaned from each said chargeable surface by said cleaning roller; and a pre-wetting oil reservoir which supplies said rotatable roller assembly with said pre-wetting oil.

25. The color electrographic printing apparatus of claim 19 wherein said rotatable roller assembly of each of said liquid development assemblies comprises at least first and second rollers in contact with one another so that said pre-wetting oil is transferred from said first roller to said second roller, and from said second roller to said charge bearing member.

26. The color electrographic printing apparatus of claim 19 wherein said ink head assembly of each of said liquid development assemblies comprises at least first and second rollers in contact with one another so that said ink is transferred from said first roller to said second roller and from said second roller to said charge bearing member.

27. The color electrographic printing apparatus of claim 19 wherein said chargeable surface of each of said liquid development assemblies is in direct contact with said surface of said transfer member so that said colored developed image is transferred from said charge bearing surface to said surface of said transfer member by contact pressure.

28. The color electrographic printing apparatus of claim 19 wherein said surface of said transfer member of each of said liquid development assemblies is in direct contact with said substrate so that said developed image is transferred from said surface of said transfer member to said substrate by contact pressure.

29. An electrographic printing apparatus with a liquid development system, comprising:

a) a rotatable charge bearing member having a chargeable surface;

b) a rotatable roller assembly configured to apply a chargeable pre-wetting oil to said chargeable surface;

c) a charger which charges said pre-wetting oil on said chargeable surface;

d) a discharging unit which discharges selected areas of said pre-wetting oil to produce an electrostatic latent image thereon;

e) an ink head assembly comprising at least first and second rollers in contact with one another wherein said second roller has a charged brush circumferentially arranged on its surface, said charged brush having a polarity opposite to the polarity of liquid toner advanced from said ink head assembly so that said liquid toner is attracted to said charged brush of said second roller and then transferred onto said electrostatic latent image to produce a developed image; and f) a transfer member having a surface configured to receive said developed image from said surface of said charge bearing member and then to transfer said developed image to a substrate.

30. The electrographic printing apparatus of claim 29 further comprising a substantially straight paper path along which said substrate travels past said transfer member.

31. The electrographic printing apparatus of claim 29 further comprising a cleaning roller configured to clean said chargeable surface;

a waste bin which stores residue cleaned from said chargeable surface by said cleaning roller; and a pre-wetting oil reservoir which supplies said rotatable roller assembly with said pre-wetting oil.

32. The electrographic printing apparatus of claim 29 wherein said rotatable roller assembly comprises at least first and second rollers in contact with one another so that said pre-wetting oil is transferred from said first roller to said second roller, and from said second roller to said charge bearing member.

33. The electrographic printing apparatus of claim 29 comprising a plurality of ink head assemblies of different colors configured to apply liquid color toner of a particular color to said charge bearing member to produce a colored developed image.

34. The electrographic printing apparatus of claim 29 wherein said chargeable surface is in contact with said surface of said transfer member so that said developed image is transferred from said charge bearing surface to said surface of said transfer member by contact pressure.

35. The electrographic printing apparatus of claim 29 further comprising, impression rollers positioned to press said substrate against said surface of said transfer member so that said developed image is transferred to said substrate by contact pressure.

36. A color electrographic printing apparatus having at least first and second differently colored liquid development assemblies arranged in series, each of said liquid development assemblies comprising:

a) a rotatable charge bearing member having a chargeable surface;

b) a rotatable roller assembly configured to apply a chargeable pre-wetting oil to said chargeable surface;

c) a charger which charges said pre-wetting oil on said chargeable surface;

d) a discharging unit which discharges selected areas of said pre-wetting oil to produce an electrostatic latent image thereon;

e) an ink head assembly comprising at least first and second rollers in contact with one another wherein said second roller has a charged brush circumferentially arranged on its surface, said charged brush having a polarity opposite to the polarity of liquid color toner advanced from said ink head assembly so that said liquid color toner is attracted to said charged brush and is transferred onto said electrostatic latent image to produce a developed image having at least one color;

f) a transfer member having a surface configured to receive said colored developed image from said charge bearing member; and g) a paper path along which a substrate travels past each said transfer member one after another, said substrate coming into contact with each said transfer member, so that said colored developed image on said surface of each said transfer member is transferred to said substrate in series.

37. The color electrographic printing apparatus of claim 36 further comprising a substantially straight paper path along which said substrate travels past said transfer member.

38. The color electrographic printing apparatus of claim 36 further comprising a cleaning roller configured to clean said chargeable surface;

a waste bin which stores residue cleaned from said chargeable surface by said cleaning roller; and a pre-wetting oil reservoir which supplies said rotatable roller assembly with said pre-wetting oil.

39. The color electrographic printing apparatus of claim 36 wherein said rotatable roller assembly comprises at least first and second rollers in contact with one another so that said pre-wetting oil is transferred from said first roller to said second roller, and from said second roller to said charge bearing member.

40. The color electrographic printing apparatus of claim 36 comprising a plurality of ink head assemblies of different colors configured to apply liquid color toner of a particular color to said charge bearing member to produce a colored developed image.

41. The color electrographic printing apparatus of claim 36 wherein said chargeable surface is in contact with said surface of said transfer member so that said colored developed image is transferred from said charge bearing member to said surface of said transfer member by contact pressure.

42. The color electrographic printing apparatus of claim 36 further comprising, impression rollers positioned to press said substrate against said surface of said transfer member so that said developed image is transferred to said substrate by contact pressure.

* * * * *